US005599647A

United States Patent [19]

Defieuw et al.

[11] Patent Number: 5,599,647

[45] Date of Patent: Feb. 4, 1997

[54] NEW TONING AGENTS FOR THERMOGRAPHIC AND PHOTOTHERMOGRAPHIC MATERIALS AND PROCESS

[75] Inventors: Geert Defieuw, Kessel-Lo; Marcel Monbaliu, Mortsel; Jean-Marie Dewanckele, Drongen, all of Belgium

[73] Assignee: Agfa-Gevaert N.V., Mortsel, Belgium

[21] Appl. No.: 666,974

[22] Filed: Jun. 20, 1996

[30] Foreign Application Priority Data

Jul. 7, 1995 [EP] European Pat. Off. ..... 95201863

[51] Int. Cl.[6] ..... G03C 1/35; G03C 1/498; G03C 1/73

[52] U.S. Cl. ..... 430/200; 430/203; 430/233; 430/346; 430/353; 430/542; 430/565; 430/616; 430/619; 430/964; 430/965; 503/227; 346/135.1; 544/94

[58] Field of Search ..... 430/200, 203, 430/233, 965, 617, 619, 353, 964, 346, 616, 495; 503/227; 544/94

[56] References Cited

U.S. PATENT DOCUMENTS

| | | | |
|---|---|---|---|
| 3,885,967 | 5/1975 | Sashihara et al. | 430/965 |
| 3,887,378 | 6/1975 | Klein et al. | 430/203 |
| 3,951,660 | 4/1976 | Hagemann et al. | 430/619 |
| 5,547,809 | 8/1996 | Defieuw et al. | 430/200 |

*Primary Examiner*—Richard L. Schilling
*Attorney, Agent, or Firm*—Brumbaugh, Graves, Donohue & Raymond

[57] ABSTRACT

Toning agents are provided for use in thermographic and photothermographic materials, either on their own or in combination with at least one other toning agent, with improved compatibility with hydrophobic media as shown by reduced crystallization and reduced diffusion through the material, which properties enabling an improved imaging performance to be achieved and in particular a more neutral image tone after storage.

20 Claims, No Drawings

NEW TONING AGENTS FOR THERMOGRAPHIC AND PHOTOTHERMOGRAPHIC MATERIALS AND PROCESS

This application claims the benefit of U.S. Provisional Application No. 60/003,751 filed Sep. 14, 1995.

DESCRIPTION

1. Field of the Invention

The present invention relates to toning agents for thermographic and photothermographic imaging processes.

2. Background of the Invention

Thermal imaging or thermography is a recording process wherein images are generated by the use of thermal energy.

In thermography three approaches are known:

1. Direct thermal formation of a visible image pattern by imagewise heating of a recording material containing matter that by chemical or physical process changes colour or optical density.

2. Imagewise transfer of an ingredient necessary for the chemical or physical process bringing about changes in colour or optical density to a receptor element containing other of the ingredients necessary for said chemical or physical process followed by uniform heating to bring about said changes in colour or optical density.

3. Thermal dye transfer printing wherein a visible image pattern is formed by transfer of a coloured species from an imagewise heated donor element onto a receptor element.

Thermographic materials of type 1 can be rendered photothermographic by incorporating a photosensitive agent which after exposure to visible or IR light is capable of catalyzing or participating in a thermographic process bringing about changes in colour or optical density.

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals.

A survey of "direct thermal" imaging methods is given e.g. in the book "Imaging Systems" by Kurt I. Jacobson-Ralph E. Jacobson, The Focal Press—London and New York (1976), Chapter VII under the heading "7.1Thermography". Thermography is concerned with materials which are substantially light-insensitive, but are sensitive to heat or thermographic.

Most of the "direct" thermographic recording materials are of the chemical type. On heating to a certain conversion temperature, an irreversible chemical reaction takes place and a coloured image is produced.

A wide variety of chemical systems has been suggested some examples of which have been given on page 138 of the above mentioned book of Kurt I. Jacobson et el., describing the production of a silver metal image by means of a thermally induced oxidation-reduction reaction of a silver soap with a reductor.

According to U.S. Pat. No. 3,080,254 a typical heat-sensitive copy paper includes in the heat-sensitive layer a thermoplastic binder, e.g ethyl cellulose, a water-insoluble silver salt, e.g. silver stearate and an appropriate organic reductor, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90°–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermo-sensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

In European Patent Application No. 94200612.3, a thermographic process is provided using (i) a reductor donor element comprising on a support a donor layer containing a binder and a thermotransferable reducing agent capable of reducing a silver source to metallic silver upon heating and (ii) a receiving element comprising on a support a receiving layer comprising a silver source capable of being reduced by means of heat in the presence of a reducing agent, said thermographic process comprising the steps of bringing said donor layer of said reductor donor element into face to face relationship with said receiving layer of said receiving element, image-wise heating a thus obtained assemblage by means of a thermal head, thereby causing image-wise transfer of an amount of said thermotransferable reducing agent to said receiving element in accordance with the amount of heat supplied by said thermal head and separating said donor element from said receiving element. This printing method is further referred to as 'reducting agent transfer printing' or 'RTP'.

In European Patent Application No., EP94200787 a donor element is provided for use in thermal transfer printing wherein said donor element comprises on a support (a) a donor layer comprising a binder, a thermotransferable reducing agent capable of reducing a silver source to metallic silver upon heating and a thermotransferable toning agent and (b) a heat-resistant layer provided on the side of the support opposite to the side having said donor layer.

As described in "Handbook of Imaging Materials", edited by Arthur S. Diamond—Diamond Research Corporation—Ventura, Calf., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300° to 400° C. and the heating time per picture element (pixel) may be less than 1.0 ms, the pressure contact of the thermal printhead with the recording material being e.g. 200–500 g/cm$^2$ to ensure a good transfer of heat.

Thermographic materials can also be image-wise or pattern-wise heated by means of a modulated laser beam. For example, image-wise modulated infra-red laser light is absorbed in the thermographic material by infra-red light absorbing substance converting infra-red radiation into the heat necessary for the imaging reaction. In said embodiment the thermographic material contains light-into-heat converting substance, e.g. infrared radiation absorbing substances.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

When used in thermographic recording operating with thermal printheads said recording materials are not suitable for reproducing images with fairly large number of grey levels as is required for continuous tone reproduction.

According to EP-A 622 217 relating to a method for making an image using a direct thermal imaging element, improvements in continuous tone reproduction are obtained by heating the thermal recording element by means of a thermal head having a plurality of heating elements, characterized in that the activation of the heating elements is executed line by line with aduty cycle Δ representing the ratio of activation time to total line time in such a way that the following equation is satisfied:

$$P \leqq P_{max} = 3.3 W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

In European Patent Application No. EP93202599.2 a recording method is provided comprising the steps of:

(1) image-wise projecting liquid, called ink, in the form of droplets onto a receiving material containing a substance reacting with another substance contained in said droplets is capable of forming a visually detectable product, characterized in that according to a first mode said receiving material contains at least one substantially light-insensitive silver salt and said ink contains a reducing agent for said silver salt, and according to a second mode said receiving material contains said reducing agent and the ink contains said silver salt, and optionally (2) heating said receiving material during and/or after the deposition of said ink on said receiving material to start or enhance reduction of said silver salt(s) forming thereby image-wise a deposit of silver metal in said receiving material.

In European Patent Application No. EP 94202848 an electro(stato)graphic method is provided comprising the steps of image-wise applying toner particles to a final non-photoconductive substrate and fixing said toner particles on said final substrate, characterized in that (i) said toner particles comprise at least one reductant (compound A) and said final substrate comprises at least one substantially light-insensitive silver salt (compound B) or vice versa, so as to be capable, upon reaction of compound A and B, of forming a light absorbing substance in said final substrate, (ii) said toner particles optionally comprise a light absorbing pigment or dye, (iii) said light absorbing substance can give a maximum density ($D_{max}$)>2.00 either on itself or in combination with said light absorbing pigment or dye and (iv) said toner particles are fixed on to the final substrate by heat or by heat and pressure.

Examples of photothermographic materials are the so-called "Dry Silver" photographic materials of the 3M Company, which are reviewed by D. A. Morgan in "Handbook of Imaging Science", edited by A. R. Diamond, page 43, published by Marcel Dekker in 1991.

U.S. Pat. No. 3,152,904 discloses an image reproduction sheet which comprises a radiation-sensitive heavy metal salt which can be reduced to free metal by a radiation wave length between an X-ray wave length and a five microns wave length and being distributed substantially uniformly laterally over said sheet, and as the image forming component an oxidation-reduction reaction combination which is substantially latent under ambient conditions and which can be initiated into reaction by said free metal to produce a visible change in colour comprising an organic silver salt containing carbon atoms and different from said heavy metal salt as an oxidizing agent and in addition an organic reducing agent containing carbon atoms, said radiation-sensitive heavy metal salt being present in an amount between about 50 and about 1000 parts per million of said oxidation-reduction reaction combination.

U.S. Pat. No. 3,951,660 discloses a photographic radiation sensitive recording material having therein a radiation sensitive composition and at least one layer containing dispersed in a binding agent a substantially non-light sensitive silver salt, a reducing agent for the non-light sensitive silver salt, and a toner compound, the improvement which comprises the toner being a heterocyclic toner compound of the following formula:

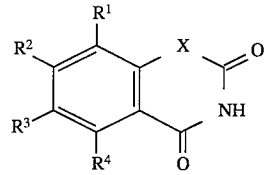

in which X represents O or N—$R^5$; $R^1$, $R^2$, $R^3$ or $R^4$ represent hydrogen, alkyl, cycloalkyl, alkoxy, alkylthio, hydroxy, dialkylamino or halogen, in addition to which $R^1$ and $R^2$ or $R^3$ and $R^3$ or $R^3$ and $R^4$ can represent the ring members required to complete an anellated aromatic ring, and $R^5$ represents alkyl.

U.S. Pat. No. 3,885,967 discloses a photosensitive material for a thermally developable lightsensitive element which comprises:

a) a silver salt component comprising silver laurate or silver caprate, b) a catalytic amount of a photosensitive silver halide component comprising a photosensitive silver halide, or a compound which reacts with silver laurate or silver caprate to form a photosensitive silver halide, c) a reducing agent, d) a binder, and e) a toning agent comprising a compound represented by the formula:

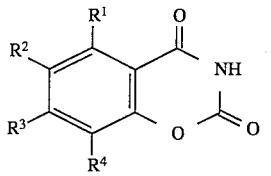

wherein $R_1$, $R_2$, $R_3$ and $R_4$ each represents a hydrogen atom, an alkyl group, an aryl group, an acylamido group, a halogen atom, a hydroxyl group or a nitro group.

Thermographic and photothermographic materials with prior art toning agents exhibit poor storage properties, as is the case with e.g. phthalazinone, and/or an image colour which has an insufficiently neutral tone for black and white images, as is the case with e.g. succinimide, phthalimide, phthalic acid and phthalazine. The use of 3,4-dihydro-2,4-dioxo-1,3,2H-benzoxazine as a toning agent in thermographic materials, as disclosed in U.S. Pat. No. 3,951,660, represented an improvement in storage properties and in the neutrality of the image tone, whether substituted, as disclosed in U.S. Pat. No. 3,885,967 and U.S. Pat. No. 3,951,660, or unsubstituted, as disclosed in U.S. Pat. No. 3,951,660. Such toning agents are insufficiently soluble in ecologically acceptable coating solvents and thermographic materials containing these toning agents exhibit a unacceptably strong deterioration in image colour and an unacceptable increase in image background (fog) upon storage. Furthermore, such toning agents diffuse through the thermographic materials to the thermal head resulting in cloudiness in the imaging material and image degradation due to thermal head contamination.

OBJECTS OF THE INVENTION

It is therefore a first object of the invention to provide a thermographic material in which the imaging characteristics obtainable are not unacceptibly degraded during storage of a thermographic material.

It is a further object of the invention to provide a thermographic material in which diffusion of toning agent through said imaging material to a thermal head is prevented.

It is a further object of the invention to provide a thermographic process utilizing said materials.

It is a still further object of the invention to provide a thermographic process, wherein said imaging process is based upon reductor transfer printing.

It is even a further object of the invention to provide a thermographic process, wherein said imaging process utilizes the imagewise exposure of said thermographic material containing a light-sensitive species capable upon exposure of forming a species capable of catalyzing said thermographic process.

Further objects and advantages of the invention will become apparent from the description hereinafter.

SUMMARY OF THE INVENTION

Materials containing therein a substantially light-insensitive organic heavy metal salt and an organic reductor therefor, the said material being capable of thermally producing an image from said organic heavy metal salt and reductor, and (photo)thermographic processes utilizing said materials are known in the prior art. The present invention provides a toning agent for use in said materials, either on its own or in combination with at least one other toning agent, with improved compatibility with hydrophobic media as shown by its increased solubility in organic coating solvents, strongly reduced crystallization upon drying and subsequent storage and reduced diffusion through the material, which properties enabling an improved imaging performance to be achieved and in particular a more neutral image tone after storage.

According to the present invention a thermographic material is provided comprising at least one element and wherein said element(s) contain(s) therein a substantially light-insensitive organic heavy metal salt and an organic reductor therefor, the said material being capable of thermally producing an image from said organic heavy metal salt and reductor, wherein said material contains a 1,3-benzoxazine-2,4-dione toning agent having general formula (I):

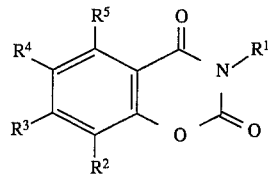

(I)

wherein $R^1$ represents hydrogen, —$CH_2OH$, —(C=O)—R, —CONHR, or M; $R^2$, $R^3$, $R^4$ and $R^5$ each independently represents hydrogen, —O—(C=O)—OR or —NH—(C=O)—OR and at least one of which is not hydrogen if $R^1$ is also hydrogen; R represents an alkyl or aryl group; and M represents a monovalent heavy metal ion.

According to the present invention a material is also provided comprising a substantially light-insensitive organic heavy metal salt and a 1,3-benzoxazine-2,4-dione toning agent having general formula (I):

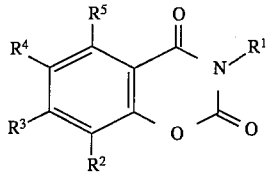

(I)

wherein $R^1$ represents hydrogen, —$CH_2OH$, —(C=O)—R, —CONHR, or M; $R^2$, $R^3$, $R^4$ and $R^5$ each independently represents hydrogen, —O—(C=O)—OR or —NH—(C=O)—OR and at least one of which is not hydrogen if $R^1$ is also hydrogen; R represents an alkyl or aryl group; and M represents a monovalent heavy metal ion.

According to the present invention a thermographic process is provided comprising the steps of: (i) image-wise heating of a material consisting of at least one element, wherein all the ingredients necessary for thermal development are present in said element(s) in thermal working relationship with one another during thermal development, with image formation in one of said elements; and (ii) separation of said elements, should the material consist of more than one element, without damage to the image containing element; characterized in that said material contains a substantially light-insensitive organic heavy metal salt, a reductor therefor and a 1,3-benzoxazine-2,4-dione toning agent having general formula (I):

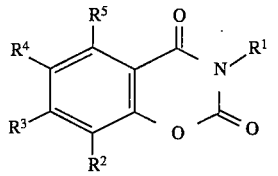

(I)

wherein $R^1$ represents hydrogen, —$CH_2OH$, —(C=O)—R, —CONHR, or M; $R^2$, $R^3$, $R^4$ and $R^5$ each independently represents hydrogen, —O—(C=O)—OR or —NH—(C=O)—OR and at least one of which is not hydrogen if $R^1$ is also hydrogen; R represents an alkyl or aryl group; and M represents a monovalent heavy metal ion.

According to the present invention a thermographic process is also provided, comprising the steps of: (i) image-wise provision of an element which renders a thermographic material thermally developable; (ii) uniform heating of said material with said image-wise provided element to produce an image; characterized in that said element and/or said material contains a substantially light-insensitive organic heavy metal salt, a reductor therefor and a 1,3-benzoxazine-2,4-dione toning agent having general formula (I):

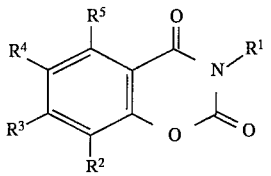

(I)

wherein $R^1$ represents hydrogen, —$CH_2OH$, —(C═O)—R, —CONHR, or M; $R^2$, $R^3$, $R^4$ and $R^5$ each independently represents hydrogen, —O—(C═O)—OR or —NH—(C═O)—OR and at least one of which is not hydrogen if $R^1$ is also hydrogen; R represents an alkyl or aryl group; and M represents a monovalent heavy metal ion. The alkyl or aryl group represented by R in the above formulae may also be substituted.

DETAILED DESCRIPTION OF THE INVENTION

A material is also provided in which said material comprises in addition to said toning agent according to formula (I) the toning agent benzo[e][1,3]oxazine-2,4-dione.

A thermographic material is also provided in which said material consists of a reductor donor element, comprising on a support a donor layer containing a binder and a thermotransferable reductor capable of reducing a substantially light-insensitive organic heavy metal salt to metal upon heating, and a receiving element, comprising on a support a receiving layer containing a substantially light-insensitive organic heavy metal salt capable of being reduced by means of heat in the presence of a thermo-transferable reductor.

A thermographic material is also provided wherein said material consists of a single element comprising on a substrate a film-forming polymeric binder in which is uniformly distributed (i) a substantially light-insensitive organic heavy metal salt, said heavy metal salt being in working relationship with (ii) an organic reductor therefor.

A thermographic material is also provided, wherein said material is photothermographic and contains in addition a photosensitive agent, or component capable of forming a photosensitive agent with said substantially light-insensitive organic heavy metal salt, capable after exposure to light of catalyzing the thermal reduction of the heavy metal ions of said substantially light-insensitive organic heavy metal salt to metal with said reductor.

According to a preferred embodiment said photosensitive agent is a silver halide and said component capable of forming a photosensitive agent is a component capable of forming a silver halide.

A thermographic material is also provided in which said material, containing a substantially light-insensitive organic heavy metal salt and an organic reductor therefor, consists of an element comprising liquid droplets containing a light-insensitive organic heavy metal salt and/or an organic reductor therefor and a receiving element comprising on a substrate a film-forming polymeric binder in which is uniformly distributed a light-insensitive organic heavy metal salt and/or an organic reductor therefor.

A thermographic material is also provided in which said material, containing a substantially light-insensitive organic heavy metal salt and an organic reductor therefor, consists of an element comprising solid toner particles containing a light-insensitive organic heavy metal salt and/or an organic reductor therefor and a receiving element comprising on a substrate a film-forming polymeric binder in which is uniformly distributed a light-insensitive organic heavy metal salt and/or an organic reductor therefor.

According to a preferred embodiment the substantially light-insensitive organic heavy metal salt used in said thermographic and photothermographic materials is a substantially light-insensitive organic silver salt.

According to a particularly preferred embodiment the substantially light-insensitive organic silver salt used in said thermographic and photothermographic materials is a substantially light-insensitive fatty acid silver salt e.g. silver behenate.

A thermographic process is also provided, wherein said material consists of a reductor donor element, comprising on a support a donor layer containing a binder and a thermotransferable reductor capable of reducing a substantially light-insensitive organic heavy metal salt to metal upon heating, and a receiving element, comprising on a support a receiving layer containing a substantially light-insensitive organic heavy metal salt capable of being reduced by means of heat in the presence of a thermotransferable reductor; comprising the steps of: (i) bringing said reductor donor element into face to face relationship with said receiving element; (ii) image-wise heating a thus obtained assemblage, thereby causing image-wise transfer of an amount of said thermotransferable reductor to said receiving element in accordance with the amount of heat supplied by said thermal head; and (iii) separating said donor element from said receiving element.

A thermographic process is also provided, wherein said material consists of a single element comprising on a substrate a film-forming polymeric binder in which is uniformly distributed (i) a substantially light-insensitive organic heavy metal salt, said heavy metal salt being in thermal working relationship with (ii) an organic reductor therefor.

A thermographic process is also provided, wherein said thermographic process is carried out by means of a thermal head containing a plurality of image-wise electrically energized heating elements.

A thermographic process is also provided, wherein said material is photothermographic and comprises on a substrate uniformly distributed in a film-forming polymeric binder a substantially light-insensitive organic heavy metal salt, a reductor in thermal working relationship therewith and a photosensitive agent, or component capable of forming a photosensitive agent with said substantially light-insensitive organic heavy metal salt, which after image-wise exposure to light is converted into said image-wise provided element which renders said thermographic material thermally developable by catalyzing the reduction of the heavy metal ions of said organic heavy metal salt to metal with said reductor upon subsequent uniform heating.

A thermographic process is also provided, wherein said material consists of said image-wise provided element, which contains an ingredient necessary for thermal development, and a receiving element, said material comprising in addition to said toning agent according to formula (I) a substantially light-insensitive organic heavy metal salt and a reductor therefor; characterized in that said image-wise provided element is applied as liquid droplets or solid particles.

According to a preferred embodiment said 1,3-benzoxazine-2,4-dione toning agent has the general formula (I) wherein $R^1$ represents hydrogen; $R^2$, $R^3$, $R^4$ and $R^5$ each independently represents hydrogen or —O—(C═O)—OR and at least one of them is not hydrogen: and R represents an ethyl, n-propyl, isopropyl or butyl group.

1,3-benzoxazine-2,4-dione compounds according to the following formulae are particularly suitable as toning agents according to the present invention:

(1)

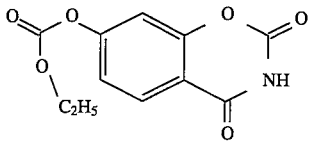

(2)

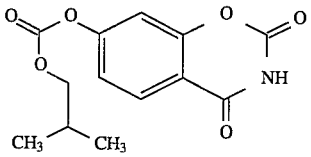

(3)

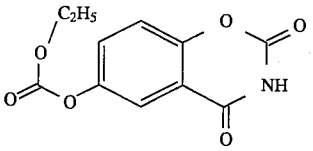

(4)

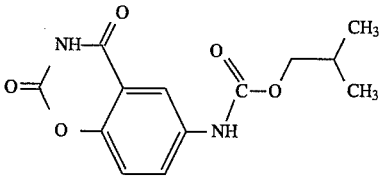

(5)

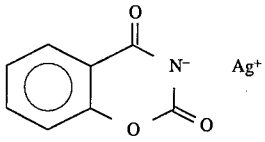

(6)

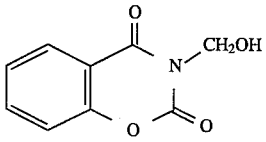

(7)

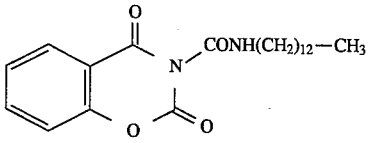

(8)

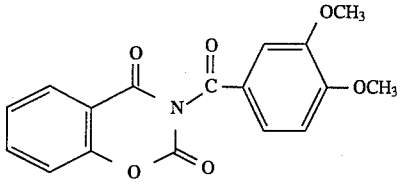

(9)

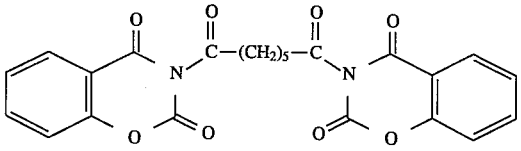

-continued (10)

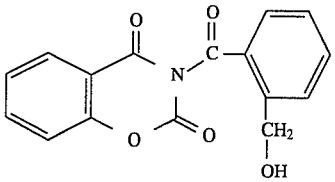

Substitution of a —(C═O)—NH— group in a heterocyclic ring-system at the nitrogen with a —$CH_2OH$ group; with a —(C═O)—R group, where R is alkyl, aryl, substituted aryl, aralkyl, or alkoxy; and with a —(C═O)—NHR group, where R represents an alkyl group, a phenyl group, a naphthyl group, a benzyl group or a cycloalkyl group: has been described for the closely related compound phthalazinone in U.S. Pat. No. 4,510,236, U.S. Pat. No. 3,446,648 and U.S. Pat. No. 3,844,797 respectively.

For illustrative purposes the preparation of benzo[e][1,3]-oxazine-2,4-dione compounds 1 to 5 mentioned above are given below:

PREPARATION OF COMPOUND 1

1,336 g (13.2moles) of triethylamine were added dropwise over 45 min to a stirred suspension of 918.2 g (6 moles) of 2,4-dihydroxybenzamide and 1,432 g (13.2moles) of ethylchloroformate in 4.5 L of ethyl acetate at 50° C. The reaction mixture was then cooled to room temperature, stirred for 1 hour at room temperature, refluxed for 9 hours and finally cooled to 0° C. The precipitate formed was filtered off, washed with 6 L of distilled water, dried over phosphous pentoxide, washed with 3 L of 2-butanone, filtered off and dried over phosphorus pentoxide to give 1,082 g (72% yield) of compound 1 with a melting point of 178° C.

PREPARATION OF COMPOUND 2

22.3 g (0.22 moles) of triethylamine were added dropwise over 45 min to a stirred suspension of 15.3 g (0.1 moles) of 2,4-dihydroxybenzamide and 30 g (0.22 moles) of isobutylchloroformate in 150 mL of ethyl acetate at 40° to 45° C. The reaction mixture was then cooled to room temperature, refluxed for 2 hours and finally cooled to 0° C. The precipitate was filtered off, washed twice, each time with 250 mL of distilled water, filtered off and dried at 50° C. to give 16.7 g (59.8% yield) of compound 2 with a melting point of 175° C.

PREPARATION OF COMPOUND 3

A solution of 45.57 g (0.42 moles) of ethylchloroformate in 50 mL of toluene was added dropwise over 10 min to a stirred emulsion of 16.8 g (0.42 moles) of sodium hydroxide and 21.42 g (0.14 moles) of 2,5-dihydroxy-benzamide in a mixture of 50 mL of distilled water and 250 mL of toluene, whereupon the reaction mixture heats up, due to the exothermic nature of the reaction, and precipitation of compound 3 begins. After stirring for 2.5 hours at 40° C. to complete the reaction, the precipitate was filtered off and recrystallized from isopropanol giving 7.6 g (43.2% yield) of compound 3 with a melting point of 190° to 192° C.

PREPARATION OF COMPOUND 4

A solution of 2.04 g (0.015 moles) of isobutylchloroformate in 10 mL of N,N-dimethylacetamide was added dropwise over 10 minutes to a solution of 2.67 g (0.015 moles) of 6-amino-benzo[e][1,3]oxazine-2,4-dione and 1.2 mL of pyridine in 20 mL of N,N-dimethylacetamide at 0° C. The reaction solution was allowed to warm up to room temperature, stirred for 30 minutes at room temperature and finally poured into 400 mL of ice-water, whereupon compound 4 precipitated out. This was then filtered off, washed thrice, each time with 50 mL of distilled water, and then dried in vacuum at 40° C. over phosphorus pentoxide giving 3.7 g (88.7% yield) of compound 4. After further purification 3 g (71%) of compound 4 was obtained with a melting point of 206° to 208° C.

PREPARATION OF COMPOUND 5

40.75 g (0.25 moles) of benzo[e][1,3]oxazine-2,4-dione (comparative compound F) were added to a stirred solution of 10 g (0.25 moles) of sodium hydroxide in 400 mL of distilled water at room temperature. Once solution had taken place, a solution of 42.5 g (0.25 moles) of silver nitrate in 400 mL of distilled water was added, whereupon a white precipitate of compound 5 was immediately formed. After 30 minutes stirring, the precipitate was filtered off, washed 4 times, each with 50 mL of distilled water, and dried in vacuum at 40° C. over phosphorus pentoxide giving 66 g (98% yield) of compound 5 with a melting point of 260° C. Since compound 5 is light-sensitive, the preparation was carried out in the dark.

Substantially light-insensitive organic heavy metal salts particularly suited for use in a thermographic material according to the present invention are organic silver and iron salts. Preferred organic silver salts according to the present invention are silver salts of aliphatic carboxylic acids known as fatty acids, wherein the aliphatic carbon chain has preferably at least 12 C-atoms, e.g. silver laurate, silver palmirate, silver stearate, silver hydroxystearate, silver oleate and silver behenate, which silver salts are also called "silver soaps"; silver dodecyl sulphonate described in U.S. Pat. No. 4,504,575; and silver di-(2-ethylhexyl)sulfosuccinate described in EP-A 227 141. Silver salts of modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

The silver image density depends on the coverage of the above defined reductor(s) and organic silver salt(s) and has to be preferably such that, on heating above 100° C., an optical density of at least 1.5 can be obtained.

Useful substantially light-insensitive organic iron salts are e.g. iron salts of an organic acid, e.g. the iron salts described in published European patent application 0 520 404, more particularly iron o-benzoylbenzoate.

Suitable organic reductors for the reduction of said substantially light-insensitive organic heavy metal salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reductors, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly useful are polyhydroxy spiro-bis-indane compounds, especially these corresponding to the following general formula:

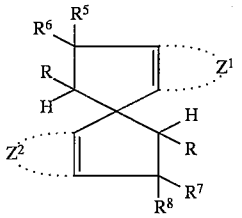

wherein:

R represents hydrogen or alkyl, e.g. methyl or ethyl, each of $R^5$ and $R^6$ (same or different) represents, an alkyl group, preferably methyl group or a cycloalkyl group, e.g. cyclohexyl group, each of $R^7$ and $R^8$ (same or different) represents, an alkyl group, preferably methyl group or a cycloalkyl group, e.g. cyclohexyl group, and each of $Z^1$ and $Z^2$ (same or different) represents the atoms necessary to close an aromatic ring or ring system, e.g. benzene ring, substituted with at least two hydroxyl groups in ortho- or para-position and optionally further substituted with at least one hydrocarbon group, e.g an alkyl or aryl group.

In particular the polyhydroxy-spiro-bis-indane compounds described in U.S. Pat. No. 3,440,049 as photographic tanning agent are mentioned, more especially 3,3,3',3'-tetramethyl-5,6,5',6'-tetrahydroxy-1,1'-spiro-bis-indane (reductor Z in invention examples and comparative examples) and 3,3,3',3'-tetramethyl-4,6,7,4',6',7'-hexahydroxy-1,1'-spiro-bis-indane. Indane is also known under the name hydrindene.

Among the catechol-type reductors, by which is meant reductors containing at least one benzene nucleus with two hydroxy groups (—OH) in ortho-position, are preferred, e.g. catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxybenzoic acid esters. Particularly preferred catechol-type reductors, described in unpublished European Patent Application EP 9420154, are benzene compounds in which the benzene nucleus is substituted by no more than two hydroxy groups which are present in 3,4-position on said nucleus and have in the 1-position of said nucleus a substituent linked to said nucleus by means of a carbonyl group.

During the thermal development process the reductor must be present in such a way that it is able to diffuse to said substantially light-insensitive organic heavy metal salt particles so that reduction of said organic heavy metal salt can take place.

The metal image density depends upon the coverage of reductor and organic heavy metal salt and has preferably to be such that upon heating an optical density of at least 1.5 can be obtained. Preferably at least 0.10 moles of reductor per mole of organic heavy metal salt is used.

The above mentioned reductors being considered as primary or main reductors may be used in conjunction with so-called auxiliary reductors. Such auxiliary reductors are e.g. sterically hindered phenols, that on heating become reactive partners in the reduction of the substantially light-insensitive organic heavy metal salt such as silver behenate, such as described in U.S. Pat. No. 4,001,026; or are hisphenols, e.g. of the type described in U.S. Pat. No. 3,547,648. The auxiliary reductors may be present in the imaging layer or in a polymeric binder layer in thermal working relationship thereto.

Preferred auxiliary reductors are sulfonamidophenols corresponding to the following general formula:

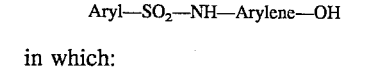

$$\text{Aryl—SO}_2\text{—NH—Arylene—OH}$$

in which:

Aryl represents a monovalent aromatic group, and

Arylene represents a bivalent aromatic group, having the —OH group preferably in para-position to the —$SO_2$—NH— group.

Sulfonamidophenols according to the above defined general formula are described in the periodical Research Disclosure, February 1979, item 17842, in U.S. Pat. Nos. 4,360,581 and 4,782,004, and in published European Patent Application No. 423 891, wherein these reductors are mentioned for use in a photothermographic material in which photosensitive silver halide is present in catalytic proximity to a substantially light-insensitive silver salt of an organic acid.

Other auxiliary reductors that may be used in conjunction with the above mentioned primary reductors are organic reducing metal salts, e.g. stannous stearate described in U.S. Pat. Nos. 3,460,946 and 3,547,648.

Photosensitive agents capable of rendering said thermographic materials photothermographic i.e. being able upon exposure of forming a species capable of catalyzing the reduction of the heavy metal ions of said organic heavy metal salt to metal by a reductor in thermal working relationship therewith, upon the application of heat, should be in intimate contact with said organic heavy metal salt. This can be achieved by producing said light-sensitive species "ex situ" and then adding it to said organic heavy metal salt or "in situ" by preparing said photosensitive agent in the presence of said organic heavy metal salt. Suitable photosensitive agents are heavy metal organic or inorganic salts, preferably of a Group lb metal of the Periodic Table, with metal diazo-sulfonate salts; salts of a hydrogen halide, such as chloride, bromide or iodide: or salts of nitric or sulfinic acid being preferred. Suitable metals include silver, copper, chromium, cobalt, platinum and gold; with silver being preferred. Mixtures of the above may also be used.

A simple test may be used to determine whether or not a particular metal salt can photogenerate a catalyst (free metal) for the reducing of the silver oxidizing agent with the reductor. A freshly prepared sample of the metal salt in question (50 mg) is intimately admixed with an aqueous or alcoholic suspension or dispersion (5 ml) of silver behenate (0.5 g). This dispersion is coated on filter paper and dried. The coated paper is then overcoated with aqueous or alcoholic solution of a 0.5% aqueous or alcoholic solution (5 ml) of a reducing agent, preferably hydroquinone and again dried. No immediate reaction should take place in the absence of light. This coated filter paper is then exposed to light (about 5–10 s with RS sun lamps 6 inches away) and heated to about 90°–100° C. for 5 s. If the exposed paper darkens more rapidly than a similar paper sample under the same conditions without the metal salt, the salt is suitable as a photosensitive generator of a catalyst.

Said photosensitive agent may be spectrally sensitized in the visible spectrum and in the IR-range of the spectrum with various known dyes including cyanine, merocyanine, styryl, hemicyanine, oxonol, hemioxonol and xanthene dyes. Useful cyanine dyes include those having a basic nucleus, such as a thiazoline nucleus, an oxazoline nucleus, a pyrroline nucleus, a pyridine nucleus, an oxazole nucleus, a thiazole nucleus, a selenazole nucleus and an imidazole nucleus. Useful merocyanine dyes which are preferred include those having not only the above described basic nuclei but also acid nuclei, such as a thiohydantoin nucleus, a rhodanine nucleus, an oxazolidinedione nucleus, a thiazolidinedione nucleus, a barbituric acid nucleus, a thiazolinone nucleus, a malononitrile nucleus and a pyrazolone nucleus. In the above described cyanine and merocyanine dyes, those having imino groups or carboxyl groups are particularly effective.

Thermographic materials rendered photosensitive by the presence of a photosensitive agent may contain anti-halation or acutance dyes which absorbs light which has passed through the photosensitive layer, thereby preventing its reflection.

The film-forming binder of the recording layer containing the substantially light-insensitive organic heavy metal salt may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aidehyde, preferably polyvinyl butyral, copolymers of acrylonitrile and acrylamide, polyacrylic acid esters, polymethacrylic acid esters, polystyrene and polyethylene or mixtures thereof.

A particularly suitable polyvinyl butyral containing a minor amount of vinyl alcohol units is marketed under the trade name BUTVAR B79 of Monsanto USA and provides a good adhesion to paper and properly subbed polyester supports.

The binder to organic heavy metal salt weight ratio is preferably in the range of 0.2 to 6, and the thickness of the recording layer is preferably in the range of 5 to 50 μm.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a nonhydrolyzable organic material which is in solid state in the recording layer at temperatures below 50° C. but becomes a plasticizer for the recording layer in the heated region and/or liquid solvent for at least one of the redox-reactants, e.g. the reductor for the substantially light-insensitive organic heavy metal salt, at a temperature above 60° C. Useful for that purpose are a polyethylene glycol having a mean molecular weight in the range of 1,500 to 20,000 described in U.S. Pat. No. 3,347,675. Further are mentioned compounds such as urea, methyl sulfonamide and ethylene carbonate being heat solvents described in U.S. Pat. No. 3,667,959, and compounds such as tetrahydro-thiophene-1, 1-dioxide, methyl anisate and 1,10-decanediol being described as heat solvents in Research Disclosure, December 1976, (item 15027) pages 26–28. Still other examples of heat solvents have been described in U.S. Pat. Nos. 3,438,776, and 4,740,446, and in published EP-A 0 119 615 and 0 122 512 and DE-A 3 339 810.

As a binder for the donor layer for reductor transfer printing (RTP), hydrophilic or hydrophobic binders can be used, although the use of hydrophobic binders is preferred.

Hydrophilic binders which can be used are polyvinylalcohol, gelatine, polyacrylamide and hydrophilic cellulosic binders such as hydroxyethyl cellulose, hydroxypropyl cellulose and the like.

The hydrophobic binders may be used as a dispersion in e.g. water or as a solution in an organic solvent.

Suitable binders for the donor layer are cellulose derivatives, such as ethyl cellulose, methyl cellulose, cellulose nitrate, cellulose acetate formaye, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl acetate, polyvinyl butyral, copolyvinyl butyral-vinyl acetalvinyl alcohol, polyvinyl pyrrolidone, polyvinyl acetoacetal, polyacrylamide; polymers and copolymers derivated from acrylates and acrylate derivatives, such as polymethyl methacrylate and styrene-acrylate copolymers; polyester resins; polycarbonates; copoly(styrene-co-acrylonitrile); polysulfones; polyphenylene oxide; organosilicones, such as polysiloxanes; epoxy resins and natural resins, such as gum arabic. Preferably, the binder for the donor layer of the present invention comprises poly(styrene-coacrylonitrile) or a mixture of poly(styrene-co-acrylonitrile) and a toluenesulphonamide condensation product.

The binder for the donor layer preferably comprises a copolymer comprising styrene units and acrylonitrile units, preferentially at least 60% by weight of styrene units and at least 25% by weight of acrylonitrile units binder. The binder copolymer may comprise other comonomers than styrene units and acrylonitrile units. Suitable other comonomers are e.g. butadiene, butyl acrylate, and methyl methacrylate. The binder copolymer preferably has a glass transition temperature of at least 50° C.

It is also possible to use a mixture of the copolymer comprising styrene units and at least 15% by weight of acrylonitrile units with another binder known in the art, but preferably the acrylonitrile copolymer is present in an amount of at least 50% by weight of the total amount of binder.

The donor layer generally has a thickness of about 0.2 to 5.0 μm, preferably 0.4 to 2.0 μm, and the amount ratio of reducing agent to binder generally ranges from 9:1 to 1:3 by weight, preferably from 3:1 to 1:2 by weight.

In addition to said ingredients the thermographic material may contain other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Ö1 A (tradename of BAYER AG—GERMANY), ultraviolet light absorbing compounds, white light reflecting and/or ultraviolet radiation reflecting pigments, silica, and/or optical brightening agents.

The support for the one or more elements of the thermographic material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephlate. The support may be in sheet, ribbon or web form and subbed if needs be to improve the adherence to the thereon coated heat-sensitive recording layer. The support may be made of an opacified resin composition, e.g. is made of opacified polyethylene terephthalate by means of pigments and/or micro-voids and/or is coated with an opaque pigment-binder layer, and may be called synthetic paper, or paperlike film; information about such supports can be found in EP's 194 106 and 234 563 and U.S. Pat. Nos. 3,944,699, 4,187,113, 4,780,402 and 5,059,579.

In a first embodiment of the method according to the present invention the direct thermal image-wise heating of the thermographic material proceeds by Joule effect heating in that selectively energized electrical resistors of a thermal head array are used in contact or close proximity with said recording layer. Suitable thermal printing heads are e.g. a Fujitsu Thermal Head (FTP-040 MCS001), a TDK Thermal Head F415 HH7-1089 and a Rohm Thermal Head KE 2008-F3.

In a particular embodiment in order to avoid direct contact of the thermal printing heads with the recording layer not provided with an outermost protective layer, the imagewise heating of the recording layer with said thermal printing heads proceeds through a contacting but removable resin sheet or web wherefrom during said heating no transfer of recording material can take place.

In a special embodiment of image-wise heating the thermographic material, an electrically resistive ribbon is used consisting e.g. of a multilayered structure in which a carbon-loaded polycarbonate is coated with a thin aluminium film (ref. Progress in Basic Principles of Imaging Systems Proceedings of the International Congress of Photographic Science Kön (Cologne), 1986 ed. by Friedrich Granzer and Erik Moisar—Friedr. Vieweg & Sohn—Braunschweig/Wiesbaden, FIG. 6. p. 622). Current is injected into the resistive ribbon by electrically addressing a printing head electrode contacting the carbon-loaded substrate, thus resulting in highly localized heating of the ribbon beneath the energized electrode. In the present embodiment the aluminium film makes direct contact with the heat-sensitive recording layer or its protective outermost layer.

The fact that in using a resistive ribbon thermographic material heat is generated directly in the resistive ribbon and only the travelling ribbon gets hot (not the print heads) an inherent advantage in printing speed is obtained. In applying the thermal printing head technology the various elements of the thermal printing head get hot and must cool down before the head can print without cross-talk in a next position.

In a second embodiment of the method according to the present invention the recording material of said thermographic material is image-wise or pattern-wise heated by means of a modulated laser beam. For example, image-wise modulated infra-red laser light is absorbed in the recording material by infra-red light absorbing substances converting infra-red radiation into the heat necessary for the imaging reaction. In said embodiment the recording material contains light-into-heat converting substances, e.g. infrared radiation absorbing substances.

The image-wise applied laser light has not necessarily to be infrared light since the power of a laser in the visible light range and even in the ultraviolet region can be thus high that sufficient heat is generated on absorption of the laser light in the thermographic material. There is no limitation on the kind of laser used which may be a gas laser, gas ion laser, e.g. argon ion laser, solid state laser, e.g. Nd:YAG laser, dye laser or semi-conductor laser.

The use of an infrared light emitting laser and a dye-donor element containing an infrared light absorbing material is described e.g. in U.S. Pat. No. 4,912,083. Suitable infra-red light absorbing dyes for laser-induced thermal dye transfer are described e.g. in U.S. Pat. No. 4,948,777, which U.S. Pat. No. documents for said dyes and lasers applied in direct thermal imaging have to be read in conjunction herewith.

In such thermographic materials containing infra-red absorbing substances capable of converting infrared radiation into the heat necessary for the imaging reaction, anti-halation or acutance dyes may be necessary which absorb light which has passed through the layer containing infra-red absorbing substances, thereby preventing its reflection.

In a third embodiment the image- or pattern-wise heating of the thermographic material proceeds by means of pixel-wise modulated ultra-sound, using e.g. an ultrasonic pixel printer as described e.g. in U.S. Pat. No. 4,908,631.

The image signals for modulating the ultrasonic pixel printer, laser beam or electrode current are obtained directly e.g. from opto-electronic scanning devices or from an intermediary storage means, e.g. magnetic disc or tape or optical disc storage medium, optionally linked to a digital work station wherein the image informerion can be processed to satisfy particular needs.

In a particular embodiment in order to avoid local deformation of the recording layer, to improve resistance against abrasion and in order to avoid the direct contact of the printheads with the recording layer a protective coating is applied thereto. Such coating may have the same composition as an anti-sticking coating or slipping layer which is applied in thermal dye transfer materials at the rear side of the dye donor material.

A slipping layer being said outermost layer may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layer compositions are described in e.g. EP 138483, EP 227090, U.S. Pat. No. 4,567,113, 4,572,860 and 4,717,711 and in EP-A 311841.

A suitable slipping layer being here an outermost layer at the recording layer side comprises as binder a styrene-acrylonitrile copolymer or a styrene-acrylonitrile-butadiene copolymer or a mixture hereof and as lubricant in an amount of 0.1 to 10% by weight of the binder (mixture) a polysiloxane-polyether copolymer or polytetrafluoroethylene or a mixture hereof.

Another suitable outermost slipping layer may be obtained by coating a solution of at least one silicon compound and a substance capable of forming during the coating procedure a polymer having an inorganic backbone which is an oxide of a group IVa or IVb element as described in unpublished European patent application 92 200229.0 filed 28, Jan. 1992.

Other suitable protective layer compositions that may be applied as slipping (anti-stick) coating are described e.g. in published European patent applications (EP-A) 0 501 072 and 0 492 411.

The coating of any layer of the thermographic and photothermographic elements and materials of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Direct thermal imaging can be used for both the production of transparencies and reflection type prints. Such means that the support will be transparent or opaque, e.g. having a white light reflecting aspect. For example, a paper base substrate is present which may contain white reflecting pigments, optionally also applied in an interlayer between the recording material and said paper base substrate. Should a transparent base be used, said base may be colourless or coloured, e.g. has a blue colour.

In the hard copy field recording materials on a white opaque base are used, whereas in the medical diagnostic field black-imaged transparencies are widely used in inspection techniques operating with a light box.

The following examples and comparative examples illustrate the present invention:

invention examples 1 to 6 and comparative examples 1 to 12 relate to thermographic materials for reductor transfer printing;

invention examples 7 to 15 and comparative examples 13 to 26 relate to thermographic materials for non-reductor transfer printing.

The percentages and ratios are by weight unless otherwise indicated. In the comparative examples the following toning agents (toners) from the prior art are used:

(A) phthalizone;
(B) succinimide;
(C) phthalimide;
(D) phthalic acid;
(E) phthalazine;

the following toning agents (toners) from U.S. Pat. No. 3,951,660:

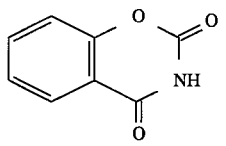
(F)

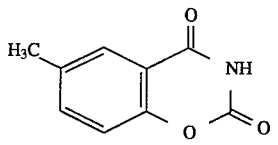
(G)

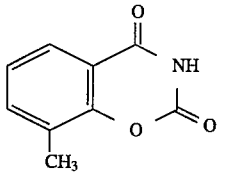
(H)

-continued (J)

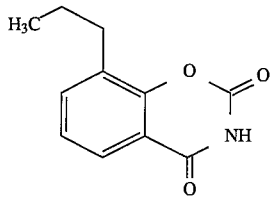

and the following toning agents (toners) from U.S. Pat. No. 3,885,967:

(K)

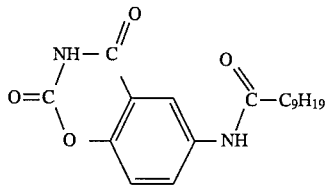

(L)

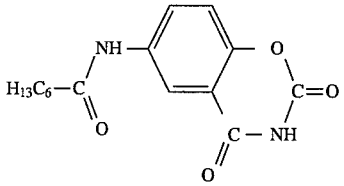

The reductors (reducing agents) used in the invention examples and comparative examples are given below:

(S)

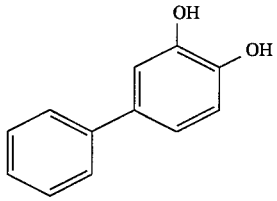

(T)

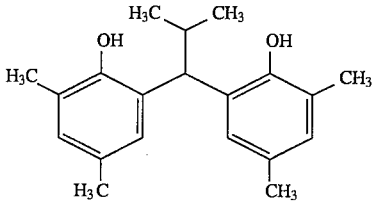

(U)

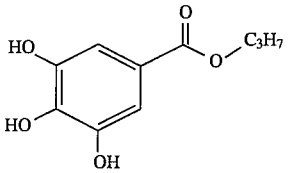

(V)

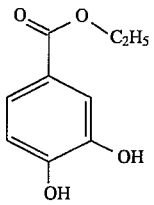

-continued (W)

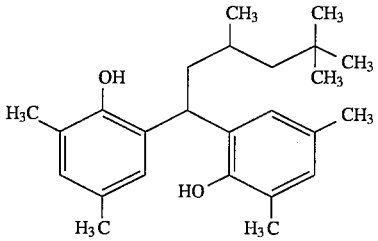

(X)

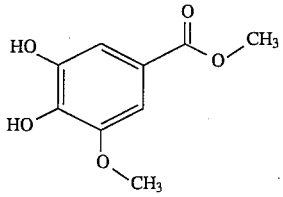

(Y)

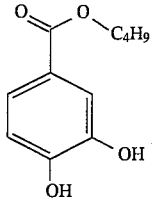

(Z)

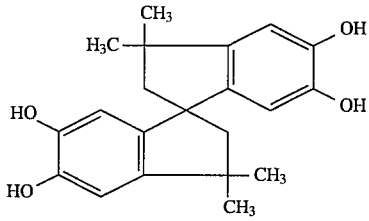

The cyan dye (CYAN DYE) used in the invention examples and the comparative examples is given below:

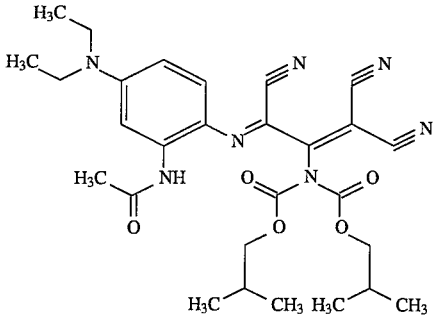

INVENTION EXAMPLES 1 to 5 and COMPARATIVE EXAMPLES 1 to 12

Production of donor and receiving elements

Reductor donor elements were obtained by coating a heat-resistant layer on the non-subbed (back) side of a 5.7 μm thick polyethylene terephthalate sheet coated on the other side from a butanone solution with a subbing layer consisting of 50 mg/m$^2$ of a copolyester, produced by the copolycondensation of terephthalic acid, isophthalic acid, adipic acid, neopentyl glycol, ethylene glycol and glycol. Said subbing layer was then coated with the reductor layer to a wet thickness of 10 μm with a butanone solution containing the following ingredients in % by weight of the particular ingredient with respect to the total quantity of solids in the dispersion: 10% of a styrene-acrylonitrile-copolymer [Luran 388S (trademark) from BASF]: 0.5% of polymethylsilylsesquioxane [Tospearl 145 (trademark) from Toshiba Silicone]; and the quantity of the particular reductor or reductors used for the particular invention example or comparative example, as given in Table I.

Receiving elements for use in combination with said reductor donor elements were prepared by coating a 170 μm thick polyethylene terephthalate sheet to a wet thickness of 100 μm with a butanone dispersion containing the following ingredients in % by weight of the particular ingredient with respect to the total quantity of solids in the dispersion: 7.28% of silver behenate; 7.28% of S-LEC BXL (tradename) (a polyvinylbutyral from Sekisui); 0.028% of Baysilone Ma. (trademark);and the quantities of the particular reductor and the particular toning agent (toner) used for the particular invention example or comparative example, as given in Table I. After drying under ambient conditions for approximately 1 minute, an abhesive topcoat consisting of 0.5 g/m$^2$ S-LEC BXL (trademark) (from Sekisui) and 0.05 g/m$^2$ Tegoglide (trademark) (from Goldschmidt) was applied from 2-butanone solution.

The toning agent (toner) quantities used in the receiving elements of the invention examples and comparative examples corresponded to an approximately constant toning agent: silver behenate molar ratio of 0.21±0.02, so that the toning capability of the different toning agents could be compared under comparable conditions.

printing of the combination of donor and receiving elements

Printing was performed by contacting the donor layer of the donor element with the receiving layer of the receiving element, followed by heating by means of a thermal head. The thermal head was a thin film thermal head heated at an average printing power of 5 W/mm$^2$ and a line time of 18 ms with a resolution of 300 dpi. The pressure applied between the thermal head and the rotating drum carrying the receiving and donor elements was 160 g/cm thermal head length. After printing, the receiving element was separated from the donor element.

The printed image was a 16-step grey scale between data levels 0 and 255 (8 bit). The data levels of the different steps were chosen equidistant with respect to the input data level in order to obtain the intrinsic sensitometry.

No RTP-printing was carried out in the cases of COMPARATIVE EXAMPLES 11 and 12, because the toning agent was insufficiently soluble to enable a receiving layer to be obtained with an acceptable coating quality.

subsequent overall heat treatment

All receiving elements were further heated on a hot-plate at 118° C. for 10 s.

evaluation of the resulting prints

The optical maximum densities of the prints were measured through a visual filter with a Macbeth TR924 densitometer in the grey scale step corresponding to a data level of 255.

The image fog-level was measured after overall heat treatment on part of the image in which no reductor had been transferred from the donor element to the receiving element.

The image colour was evaluated according to the following criteria:

BAD=image is yellowish;

FAIR=image is brownish;

GOOD=image is dark brown to black;

EXC(ellent)=image is deep black.

evaluation of the degree of crystallization of toning agent in the receiving elements The degree of crystallization of toning agent was evaluated after storage at 45° C. for 7 days and before printing, using the following criteria:

BAD=crystals of toning agent clearly visible before storage;

MOD(erate)=some crystals of toning agent visible after storage;

GOOD=no crystals of toning agent visible after storage.

further observations

It was further noted that the stability of the coating solutions for the receiving layer containing the toning agents of the present invention with respect to discoloration is considerably better than those containing toning agents of the prior art.

TABLE I

| | DONOR ELEMENT | | RECEIVING ELEMENT | | | | | | | | |
|---|---|---|---|---|---|---|---|---|---|---|---|
| | reductor | | toner | | reductor | | | | Image | | Toning agent |
| | type | conc | type | conc | type | conc | $D_{max}$ | $D_{min}$ | colour | Crystallizion | sol.* |
| Comparative examples | | | | | | | | | | | |
| 1 | S | 10 | A | 0.54 | — | — | NE# | <0.10 | FAIR | MOD | >1% |
| 2** | S | 3.5 | A | 0.474 | T | 1.67 | 2.72 | 0.13 | FAIR | MOD | >1% |
| | U | 2.5 | | | | | | | | | |
| 3 | S | 10 | B | 0.36 | — | — | NE# | <0.10 | FAIR | NE# | >0.5% |
| 4 | S | 10 | C | 0.54 | — | — | NE# | <0.10 | FAIR | NE# | <2% |
| 5 | S | 10 | D | 0.61 | — | — | NE# | <0.10 | FAIR | NE# | >1% |
| 6 | S | 10 | E | 0.49 | — | — | NE# | <0.10 | BAD | NE# | >1% |
| 7 | S | 10 | F | 0.6 | — | — | NE# | <0.10 | GOOD | BAD | 0.8% |
| 8** | S | 3.5 | F | 0.6 | T | 1.33 | 2.90 | <0.10 | GOOD | BAD | 0.8% |
| | U | 2.5 | | | | | | | | | |
| 9 | S | 3.5 | F | 0.6 | T | 0.66 | 2.16 | <0.10 | GOOD | BAD | 0.8% |
| | U | 2.5 | | | | | | | | | |
| 10 | S | 7 | J | 0.75 | — | — | 1.73 | <0.10 | BAD | NE# | >1% |
| | U | 3 | | | | | | | | | |
| | V | 3 | | | | | | | | | |

TABLE I-continued

| | DONOR ELEMENT | | RECEIVING ELEMENT | | | | | | | | Toning |
|---|---|---|---|---|---|---|---|---|---|---|---|
| | reductor | | toner | | reductor | | | | Image | | agent |
| | type | conc | type | conc | type | conc | $D_{max}$ | $D_{min}$ | colour | Crystallizion | sol.* |
| 11**** | — | — | K | 1.02 | W | 2.5 | — | — | — | — | 0.8% |
| 12**** | — | — | L | 0.89 | W | 2.5 | — | — | — | — | 0.8% |
| Invention examples | | | | | | | | | | | |
| 1** | S<br>U | 3.5<br>2.5 | 1 | 0.82 | T | 1.67 | 3.37 | <0.10 | EXC | GOOD | 3.1% |
| 2** | S<br>U | 3.5<br>2.5 | 2 | 0.91 | T | 1.67 | 2.63 | <0.10 | GOOD | GOOD | 5% |
| 3*** | X<br>U | 5<br>2.5 | 2 | 0.91 | T | 1.67 | 2.42 | <0.10 | GOOD | GOOD | 5% |
| 4 | S<br>V | 7<br>3 | 3 | 0.93 | — | — | 2.24 | <0.10 | GOOD | MOD | 3.3% |
| 5** | S<br>U | 3.5<br>2.5 | 4 | 0.85 | W | 2.5 | 2.01 | <0.10 | BAD | GOOD | 2.5% |

*solubility in butanone in % by weight
#NE = not evaluated
**2% of CYAN DYE was also added to the coating solution of the donor layer in order to improve the colour hue of the image
***1% of CYAN DYE was also added to the coating solution of the donor layer in order to improve the colour hue of the image
****toning agent was insufficiently soluble to enable a receiving layer to be obtained with acceptable coating quality It can be clearly seen from table I that the prior art toning agents exhibit a poor solubility in the coating solvent used (butanone) and a high or moderate tendency to crystallization in the receiving element during storage and furthermore that a moderate tendency to crystallization is never combined with a good image colour (neutral black). However, the toning agents of the present invention exhibit a high solubility in the coating solvent used (butanone) and a low or moderate tendency to crystallization in the receiving element during storage and furthermore that a moderate tendency to crystallization is combined with a good image colour.

INVENTION EXAMPLES 6 to 10 and COMPARATIVE EXAMPLES 13 to 20

A subbed polyethylene terephthalate support having a thickness of 175 μm was doctor blade-coated from a coating composition containing butanone as a solvent and the following ingredients so as to obtain thereon, after drying for 1 hour at 50° C., a layer containing:

silver behenate 5.12 g/m$^2$
polyvinyl butyral (BUTVAR B79-tradename) 5.12 g/m$^2$
reductor type Y 1.21 g/m$^2$
toning agent (see table II for type and quantity)

Thermographic printing

The printer was equipped with a thin film thermal head with a resolution of 300 dpi and was operated with a line time of 7.5 ms (the line time being the time needed for printing one line). During said line time the print head received constant power. The average printing power, being the total amount of electrical input energy during one line time divided by the line time and by the surface area of the heat-generating resistors was 10.5 W/mm$^2$ being sufficient to obtain maximum optical density in each of said recording materials.

During printing the print head was separated from the imaging layer by a thin intermediate material and made contact with the slipping layer of a separatable intermediate 5 μm thick polyethylene terephthalate ribbon being coated in consecutive order with a subbing layer, heat-resistant layer and said slipping layer (antifriction layer) giving the ribbon a total thickness of 6 μm.

image evaluation

The optical maximum and minimum densities of the prints given in table II were measured through a visual filter with a Macbeth TD904 densitometer in the grey scale step corresponding to data levels of 255 and 0 respectively.

For evaluating the colour neutrality the optical density (D) of the obtained images is measured with blue, green and red filter using a densitometer MacBeth TD904 (tradename). As a result thereof in order of increasing magnitude optical density values $D_1$, $D_2$ and $D_3$ were obtained. Using these values in the following equation a numerical colour value (NCV) was obtained:

$$NCV = \frac{D_1 \times D_2}{(D_3)^2}$$

The larger the NCV value the better the colour neutrality of the obtained image. Maximal colour neutrality corresponds with a NCV value of 1. NCV values were determined at optical densities (D) of 1, 2 and 3.

evaluation of the degree of crystallization of toning agent in the receiving elements The degree of crystallization of toning agent was evaluated after storage at 50° C. for 1 hour and before printing, using the following criteria:

BAD=crystals of toning agent clearly visible before storage;
MOD(erate)=some crystals of toning agent visible after storage;
GOOD=no crystals of toning agent visible after storage.

TABLE II

| | toning agent | | | image characteristics | | | | | | | | | | | Toning agent on surface after printing |
|---|---|---|---|---|---|---|---|---|---|---|---|---|---|---|---|
| | | | | freshly printed | | | | | after 3 days at 57° C. and 34% RH | | | | | | |
| | | conc. | | | | NCV | | | | | NCV | | | Cryst- | |
| | type | mol/mol AgBeh | g/m² | $D_{max}$ | $D_{min}$ | at D = 1 | at D = 2 | at D = 3 | $D_{max}$ | $D_{min}$ | at D = 1 | at D = 2 | at D = 3 | alliz-ation | |
| Comparative examples | | | | | | | | | | | | | | | |
| 13 | — | — | — | 1.5 | .07 | .04 | — | — | 1.6 | .13 | .04 | — | — | GOOD | NONE |
| 14 | A | 0.20 | 0.33 | 4.0 | .07 | .77 | .69 | .66 | 3.2 | .11 | .41 | .36 | .27 | GOOD | NONE |
| 15 | A | 0.40 | 0.66 | 3.8 | .07 | .72 | .71 | .73 | 3.4 | .13 | .56 | .60 | .30 | GOOD | YES |
| 16 | A | 0.60 | 0.99 | 4.2 | .10 | .68 | .68 | .73 | 3.8 | .29 | .66 | .68 | .65 | GOOD | YES |
| 17 | C | 0.20 | 0.34 | 3.8 | .08 | .53 | .55 | .53 | 1.5 | .13 | .05 | — | — | GOOD | NONE |
| 18 | A | 0.20 | 0.33 | 3.6 | .07 | .72 | .68 | .73 | 2.2 | .14 | .34 | .20 | — | GOOD | YES |
| | C | 0.20 | 0.34 | | | | | | | | | | | | |
| 19 | F | 0.10 | 0.19 | 3.6 | .07 | .74 | .72 | .68 | 2.3 | .13 | .42 | .15 | — | GOOD | YES |
| 20 | F | 0.20 | 0.37 | 3.5 | .08 | .72 | .71 | .65 | 3.7 | .14 | .71 | .67 | .63 | GOOD | YES |
| Examples | | | | | | | | | | | | | | | |
| 6 | 1 | 0.05 | 0.15 | 3.3 | .06 | .74 | .64 | .59 | 3.4 | .12 | .71 | .71 | .61 | GOOD | NONE |
| 7 | 1 | 0.10 | 0.30 | 3.0 | .06 | .71 | .65 | .58 | 3.2 | .12 | .73 | .69 | .66 | GOOD | NONE |
| 8 | 1 | 0.20 | 0.60 | 3.0 | .06 | .72 | .66 | .60 | 3.2 | .12 | .71 | .69 | .65 | MOD | NONE |
| 9 | 2 | 0.10 | 0.32 | 3.1 | .06 | .71 | .66 | .60 | 3.5 | .09 | .73 | .82 | .62 | GOOD | NONE |
| 10 | 2 | 0.20 | 0.64 | 3.2 | .06 | .71 | .66 | .63 | 3.2 | .12 | .72 | .66 | .61 | MOD | NONE |

The results in table II show that all the thermographic materials of the INVENTION EXAMPLES exhibited acceptable colour neutrality after storage for 3 days at 57° C. and 34% RH (relative humidity) together with no diffusion of toning agent to the surface of the thermographic material. However, although the thermographic materials of COMPARATIVE EXAMPLES 16 and 20, with prior art toning agents, exhibited acceptable colour neutrality after storage for 3 days at 57° C. and 34% RH (relative humidity) this was accompanied by diffusion of toning agent to the surface of the thermographic material which was unacceptable.

INVENTION EXAMPLES 11 and 12; and COMPARATIVE EXAMPLE 21

A subbed polyethylene terephthalate support having a thickness of 175 μm was doctor blade-coated from a coating composition containing butanone as a solvent and the following ingredients so as to obtain thereon, after drying for 1 hour at 50° C., a layer containing:

silver behenate 5.12 g/m²
polyvinyl butyral (BUTVAR B79-tradename) 20 g/m²
reductor type Z 1.21 g/m²
pimelic acid 0.41 g/m²
tetrachlorophthalic anhydride 0.16 g/m²
toning agent (see table III for type and quantity)

Thermographic printing

The printer was equipped with a thin film thermal head with a resolution of 300 dpi and was operated with a line time of 19 ms (the line time being the time needed for printing one line). During said line time the print head received constant power. The average printing power, being the total amount of electrical input energy during one line time divided by the line time and by the surface area of the heat-generating resistors was 10.1 W/mm² being sufficient to obtain maximum optical density in each of said recording materials.

During printing the print head was separated from the imaging layer by a thin intermediate material and made contact with the slipping layer of a separatable intermediate 5 μm thick polyethylene terephthalate ribbon being coated in consecutive order with a subbing layer, heat-resistant layer and said slipping layer (anti-friction layer) giving the ribbon a total thickness of 6 μm.

image evaluation

The optical maximum and minimum densities of the prints given in table III were measured through a visual filter with a Macbeth TD904 densitometer in the grey scale step corresponding to data levels of 255 and 0 respectively.

For evaluating the colour neutrality the optical density (D) of the obtained images is measured with blue, green and red filter using a densitometer MacBeth TD904 (tradename). As a result thereof in order of increasing magnitude optical density values $D_1$, $D_2$ and $D_3$ were obtained. Using these values in the following equation a numerical colour value (NCV) was obtained:

$$NCV = \frac{D_1 \times D_2}{(D_3)^2}$$

The larger the NCV value the better the colour neutrality of the obtained image, Maximal colour neutrality corresponds with a NCV value of 1. NCV values were determined at optical densities (D) of 1, 2 and 3.

evaluation of the degree of crystallization of toning agent in the receiving elements The degree of crystallization of toning agent was evaluated after storage at 50° C. for 1 hour and before printing, using the following criteria:

BAD=crystals of toning agent clearly visible before storage;
MOD(erate)=some crystals of toning agent visible after storage;
GOOD=no crystals of toning agent visible after storage,

TABLE III

| | toning agent | | | image characteristics | | | | | | | | | | | Toning agent on surface after development |
|---|---|---|---|---|---|---|---|---|---|---|---|---|---|---|---|
| | | | | freshly printed | | | | | after 3 days at 57° C. and 34% RH | | | | | | |
| | | conc. | | | | NCV | | | | | NCV | | | | |
| | type | mol/mol AgBeh | g/m² | $D_{max}$ | $D_{min}$ | at D = 1 | at D = 2 | at D = 3 | $D_{max}$ | $D_{min}$ | at D = 1 | at D = 2 | at D = 3 | Crystallization | |
| Comparative example | | | | | | | | | | | | | | | |
| 21 | F | 0.20 | 0.37 | 3.2 | .07 | .95 | .98 | .97 | 3.6 | .08 | .32 | .37 | .41 | GOOD | NONE |
| Examples | | | | | | | | | | | | | | | |
| 11 | 1 | 0.20 | 0.60 | 3.0 | .07 | .89 | .97 | .97 | 3.7 | .10 | .78 | .80 | .75 | GOOD | NONE |
| 12 | 2 | 0.20 | 0.64 | 3.1 | .07 | .76 | .74 | .74 | 3.6 | .09 | .76 | .72 | .61 | GOOD | NONE |

The results in table III show that thermographic materials with -toning agents of the present invention exhibit superior colour neutrality after storage for 3 days at 57° C. and 34% RH (relative humidity) than thermographic materials with prior art toning agents.

INVENTION EXAMPLES 13 and 14; and COMPARATIVE EXAMPLES 22 to 26

For invention example 13 and comparative examples 22 to 25, a subbed polyethylene terephthalate support having a thickness of 175 μm was doctor blade-coated from a coating composition containing butanone as a solvent and the following ingredients so as to obtain thereon, after drying for 1 hour at 50° C., a layer containing:

silver behenate 3.2 g/m²
polyvinyl butyral (BUTVAR B79-tradename) 3.2 g/m²
reductor type Z 0.61 g/m²
Baysilone (trademark) 0.011 g/m²
toning agent (see table IV for type and quantity)

For invention example 14 and comparative example 26, a subbed polyethylene terephthalate support having a thickness of 175 μm was doctor blade-coated from a coating composition containing butanone as a solvent and the following ingredients so as to obtain thereon, after drying for 1 hour at 50° C., a layer containing:

silver behenate 5.0 g/m²
polyvinyl butyral (BUTVAR B79-tradename) 5.0 g/m²
reductor type Z 0.95 g/m²
Baysilone (trademark) 0.015 g/m²
toning agent (see table V for type and quantity)

Thermographic printing

The printer was equipped with a thin film thermal head with a resolution of 300 dpi and was operated with a line time of 32 ms (the line time being the time needed for printing one line). During said line time the print head received constant power. The average printing power, being the total amount of electrical input energy during one line time divided by the line time and by the surface area of the heat-generating resistors was 14.3 W/mm² being sufficient to obtain maximum optical density in each of said recording materials.

During printing the print head was separated from the imaging layer by a thin intermediate material and made contact with the slipping layer of a separatable intermediate 5 μm thick polyethylene terephthalate ribbon being coated in consecutive order with a subbing layer, heat-resistant layer and said slipping layer (anti-friction layer) giving the ribbon a total thickness of 6 μm.

image evaluation

The optical maximum and minimum densities of the prints given in tables IV and V were measured through a visual filter with a Macbeth TD904 densitometer in the grey scale step corresponding to data levels of 255 and 0 respectively.

For evaluating the colour neutrality the optical density (D) of the obtained images is measured with blue, green and red filter using a densitometer MacBeth TD904 (tradename). As a result thereof in order of increasing magnitude optical density values $D_1$, $D_2$ and $D_3$ were obtained. Using these values in the following equation a numerical colour value (NCV) was obtained:

$$NCV = \frac{D_1 \times D_2}{(D_3)^2}$$

The larger the NCV value the better the colour neutrality of the obtained image. Maximal colour neutrality corresponds with a NCV value of 1. NCV values were determined at optical densities (D) of 1 and 2.

TABLE IV

| | toning agent | | | image characteristics | | | | Toning agent |
|---|---|---|---|---|---|---|---|---|
| | | conc. | | | | NCV | | solubility in |
| | type | mol/mol AgBeh | g/m² | $D_{max}$ | $D_{min}$ | at D = 1 | at D = 2 | butanone [% by wt] |
| Comparative examples | | | | | | | | |
| 22 | F | 0.20 | 0.23 | 2.8 | .07 | .78 | .74 | 0.8 |
| 23 | G | 0.20 | 0.25 | 2.0 | .07 | .42 | .27 | 0.6 |
| 24 | H | 0.20 | 2.25 | 2.0 | .08 | .64 | .33 | 0.6 |
| 25 | J | 0.20 | 0.29 | 0.69 | .07 | | | >5 |
| Example | | | | | | | | |
| 13 | 3 | 0.20 | 0.36 | 2.1 | .08 | .51 | .35 | 3.3 |

TABLE V

| | | | | image characteristics | | | | | | | |
|---|---|---|---|---|---|---|---|---|---|---|---|
| | toning agent | | | freshly printed | | | | after 3 days at 57° C. and 34% RH | | | |
| | | conc. | | | | NCV | | | | NCV | |
| | type | mol/mol AgBeh | g/m² | $D_{max}$ | $D_{min}$ | at D = 1 | at D = 2 | $D_{max}$ | $D_{min}$ | at D = 1 | at D = 2 |
| Comparative example | | | | | | | | | | | |
| 26 | F | 0.20 | 0.37 | 3.4 | .06 | .72 | .64 | 3.1 | .08 | .45 | .48 |
| Example | | | | | | | | | | | |
| 14 | 1 | 0.20 | 0.56 | 3.7 | .06 | .78 | .63 | 3.7 | .06 | .73 | .62 |

The results in table V show that thermographic materials with toning agents of the present invention exhibit superior colour neutrality after storage for 3 days at 57° C. and 34% RH (relative humidity) than thermographic materials with prior art toning agents.

Having described in detail preferred embodiments of the current invention, it will now be apparent to those skilled in the art that numerous modifications can be made therein without departing from the scope of the invention as defined in the following claims.

We claim:

1. A thermographic material comprising at least one element and wherein said element(s) contain(s) therein a substantially light-insensitive organic heavy metal salt and an organic reductor therefor the said material being capable of thermally producing an image from said organic heavy metal salt and reductor, wherein said material contains a 1,3-benzoxazine-2,4-dione toning agent having general formula (I):

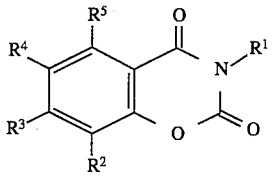

(I)

wherein $R^1$ represents hydrogen, —$CH_2OH$, —(C═O)—R, —CONHR, or M; $R^2$, $R^3$, $R^4$ and $R^5$ each independently represents hydrogen, —O—(C═O)—OR or —NH—(C═O)—OR and at least one of which is not hydrogen if $R^1$ is also hydrogen: R represents an alkyl or aryl group; and M represents a monovalent heavy metal ion.

2. A material comprising a substantially light-insensitive organic heavy metal salt and a 1,3-benzoxazine-2,4-dione toning agent having general formula (I):

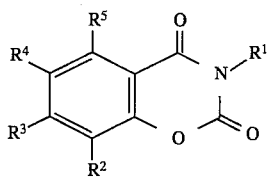

(I)

wherein $R^1$ represents hydrogen, —$CH_2OH$, —(C═O)—R, —CONHR, or M: $R^2$, $R^3$, $R^4$ and $R^5$ each independently represents hydrogen, —O—(C═O)—OR or —NH—(C═O)—OR and at least one of which is not hydrogen if $R^1$ is also hydrogen; R represents an alkyl or aryl group; and M represents a monovalent heavy metal ion.

3. A material according to claim 1 or 2 comprising in addition to said toning agent according to formula (I) the toning agent benzo[e][1,3]oxazine-2,4-dione.

4. A thermographic material according to claim 1, wherein said material consists of a reductor donor element, comprising on a support a donor layer containing a binder and a thermotransferable reductor capable of reducing a substantially light-insensitive organic heavy metal salt to metal upon heating, and a receiving element, comprising on a support a receiving layer containing a substantially light-insensitive organic heavy metal salt capable of being reduced by means of heat in the presence of a thermotransferable reductor.

5. A thermographic material according to claim 1, wherein said material consists of a single element comprising on a substrate a film-forming polymeric binder in which is uniformly distributed (i) a substantially light-insensitive organic heavy metal salt, said heavy metal salt being in working relationship with (ii) an organic reductor therefor.

6. A thermographic material according to claim 5, wherein said material is photothermographic and contains in addition a photosensitive agent, or component capable of forming a photosensitive agent with said substantially light-insensitive organic heavy metal salt, capable after exposure to light of catalyzing the thermal reduction of the heavy metal ions of said substantially light-insensitive organic heavy metal salt to metal with said reductor.

7. A material according to claim 1 or 2 in which said 1,3-benzoxazine-2,4-dione toning agent has the general formula (I) wherein $R^1$ represents hydrogen; $R^2$, $R^3$, $R^4$ and $R^5$ each independently represents hydrogen or —O—(C=O)—OR and at least one of them is not hydrogen; and R represents an ethyl, n-propyl, isopropyl or butyl group.

8. A material according to claim 7 in which said 1,3-benzoxazine-2,4-dione toning agent has the following formula:

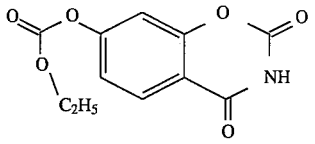

9. A material according to claim 7 in which said 1,3-benzoxazine-2,4-dione toning agent has the following formula:

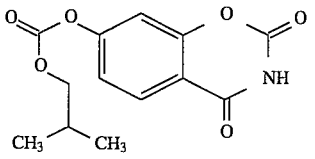

10. A material according to claim 1 or 2 in which said substantially light-insensitive organic heavy metal salt is a substantially light-insensitive organic silver salt.

11. A material according to claim 10 in which said substantially light-insensitive organic heavy metal salt is a substantially light-insensitive fatty acid silver salt.

12. A material according to claim 11 in which said substantially light-insensitive organic silver salt is silver behenate.

13. A material according to claim 6, wherein said photosensitive agent is a silver halide.

14. A material according to claim 6, wherein said component capable of forming a photosensitive agent is a component capable of forming a silver halide.

15. A thermographic process comprising the steps of: (i) image-wise heating of a material consisting of at least one element, wherein all the ingredients necessary for thermal development are present in said element(s) in thermal working relationship with one another during thermal development, with image formation in one of said elements; and (ii) separation of said elements, should the material consist of more than one element, without damage to the image containing element; characterized in that said material contains a substantially light-insensitive organic heavy metal salt, a reductor therefor and a 1,3-benzoxazine-2,4-dione toning agent having general formula (I):

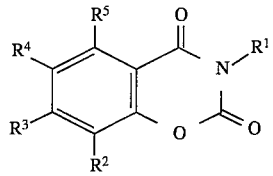

(I)

wherein $R^1$ represents hydrogen, —$CH_2OH$, —(C=O)—R, —CONHR, or M; $R^2$, $R^3$, $R^4$ and $R^5$ each independently represents hydrogen, —O—(C=O)—OR or —NH—(C=O)—OR and at least one of which is not hydrogen if $R^1$ is also hydrogen; R represents an alkyl or aryl group; and M represents a monovalent heavy metal ion.

16. A thermographic process according to claim 15, wherein said material consists of a reductor donor element, comprising on a support a donor layer containing a binder and a thermotransferable reductor capable of reducing a substantially light-insensitive organic heavy metal salt to metal upon heating, and a receiving element, comprising on a support a receiving layer containing a substantially light-insensitive organic heavy metal salt capable of being reduced by means of heat in the presence of a thermotransferable reductor; comprising the steps of: (i) bringing said reductor donor element into face to face relationship with said receiving element; (ii) image-wise heating a thus obtained assemblage by means of a thermal head, thereby causing image-wise transfer of an amount of said thermotransferable reductor to said receiving element in accordance with the amount of heat supplied by said thermal head; and (iii) separating said donor element from said receiving element.

17. A thermographic process according to claim 15, wherein said material consists of a single element comprising on a substrate a film-forming polymeric binder in which is uniformly distributed (i) a substantially light-insensitive organic heavy metal salt, said heavy metal salt being in thermal working relationship with (ii) an organic reductor therefor.

18. A thermographic process according to claim 15, wherein said thermographic process is carried out by means of a thermal head containing a plurality of image-wise electrically energized heating elements.

19. A thermographic process, comprising the steps of: (i) image-wise provision of an element which renders a thermographic material thermally developable; (ii) uniform heating of said material with said image-wise provided element to produce an image; characterized in that said element and/or said material contains a substantially light-insensitive organic heavy metal salt, a reductor therefor and a 1,3-benzoxazine-2,4-dione toning agent having general formula (I):

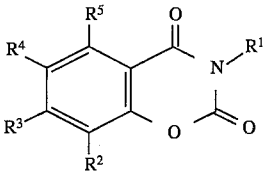

(I)

wherein $R^1$ represents hydrogen, —$CH_2OH$, —(C=O)—R, —CONHR, or M; $R^2$, $R^3$, $R^4$ and $R^5$ each independently represents hydrogen, —O—(C=O)—OR or —NH—(C=O)—OR and at least one of which is not hydrogen if $R^1$ is also hydrogen; R represents an alkyl or aryl group; and M represents a monovalent heavy metal ion.

20. A thermographic process according to claim 19, wherein said material is photothermographic and comprises on a substrate uniformly distributed in a film-forming polymeric binder a substantially light-insensitive organic heavy metal salt, a reductor in thermal working relationship therewith and a photosensitive agent, or component capable of forming a photosensitive agent with said substantially light-insensitive organic heavy metal salt, which after image-wise exposure to light is converted into said image-wise provided element which renders said thermographic material thermally developable by catalyzing the reduction of the heavy metal ions of said organic heavy metal salt to metal with said reductor upon subsequent uniform heating.

* * * * *

UNITED STATES PATENT AND TRADEMARK OFFICE

CERTIFICATE OF CORRECTION

PATENT NO. : 5,599,647

DATED : February 4, 1997

INVENTOR(S) : Geert Defieuw, et al.

It is certified that error appears in the above-indentified patent and that said Letters Patent is hereby corrected as shown below:

olumn 1 , line 58, "et el." should read --et al.--;

olumn 3, line 17, "aduty" should read --a duty--;

olumn 4, line 34, "$R^3$ and $R^{3''}$ should read --$R^2$ and $R^3$--;

olumn 11, bridging lines 38-39, "palmirate" should read --palmitate--;

olumn 15, line 23, "formaye" should read --formate--;

olumn 16, line 7, "terephlate" should read --terephthalate--;

olumn 16, line 38, "Systems Pro-" should read --Systems - Pro- --;

olumn 16, line 40, "Kön" should read --Köln--;

olumn 17, line 29, "informerion" should read --information--;

UNITED STATES PATENT AND TRADEMARK OFFICE

CERTIFICATE OF CORRECTION

PATENT NO. : 5,599,647

DATED : February 4, 1997

INVENTOR(S) : Geert Defieuw, et al.

It is certified that error appears in the above-indentified patent and that said Letters Patent is hereby corrected as shown below:

Column 21, line 20, "Ma." should read --MA--.

Signed and Sealed this

Fourth Day of November, 1997

*Attest:*

*Attesting Officer*

BRUCE LEHMAN

*Commissioner of Patents and Trademarks*